United States Patent [19]

Jones

[11] Patent Number: 4,834,365

[45] Date of Patent: May 30, 1989

[54] COMPOUND WEIGHT SYSTEM

[76] Inventor: Arthur A. Jones, 1155 NE. 77th St., Ocala, Fla. 32670

[21] Appl. No.: 181,372

[22] Filed: Apr. 14, 1988

Related U.S. Application Data

[63] Continuation-in-part of Ser. No. 60,679, Jun. 11, 1987.

[51] Int. Cl.[4] ..... A63B 21/06

[52] U.S. Cl. ..... 272/118

[58] Field of Search ..... 272/117, 118, 123, 134

[56] References Cited

U.S. PATENT DOCUMENTS

| | | | |
|---|---|---|---|
| 3,866,914 | 2/1975 | Jackson | 272/117 X |
| 3,971,555 | 7/1976 | Mahdke | 272/118 |
| 4,538,805 | 9/1985 | Parviainen | 272/118 |
| 4,546,971 | 10/1985 | Raasoch | 272/117 X |
| 4,610,449 | 9/1986 | Diercks, Jr. | 272/118 |
| 4,625,959 | 12/1986 | Schleffendorf | 272/118 |
| 4,648,594 | 3/1987 | Schleffendorf | 272/118 |
| 4,712,793 | 12/1987 | Harwick et al. | 272/117 X |
| 4,746,113 | 5/1988 | Kissel | 272/118 |
| 4,765,611 | 8/1988 | MacMillan | 272/118 |

*Primary Examiner*—Richard J. Apley
*Assistant Examiner*—Robert W. Bahr
*Attorney, Agent, or Firm*—William E. Mouzavires

[57] ABSTRACT

A compound weight system for use in exercising, or testing the human body includes upper and lower groups of weights normally resting on fixed supports, the weights in each group being, in the preferred embodiment, plates stacked one above the other and with the plates in one group having a different weight than the plates in the other group. Extending vertically through the weights for slidable movement relative to the weights is a connecting rod adapted to be connected at its upper end to a cable or chain which, in turn, may be connected to an exercise or testing device. In the preferred embodiment, the connecting rod has a series of apertures spaced along the length thereof and first and second keys are provided for selectively interconnecting any number of the weights of the first and second groups to the connecting rod such that the connected weights will move with the connecting rod in response to movement of the exercise machine. In one embodiment, the weights are held in alignment by means of fixed guide rods which extend vertically through the weights on opposite sides of the connecting rod and which guide rods are fixed so that the weights are movable along the guide rods by the connecting rod when the cable is pulled. Release of pressure on the cable allows the weights to descend along the guide rods. In another embodiment, the guide rods are eliminated and in place are used a plurality of projections on one surface of each of the plates and recesses on the opposite surface of each of the plates for receiving the projection on the next adjacent plate, the projections and recesses being complementary in shape.

30 Claims, 2 Drawing Sheets

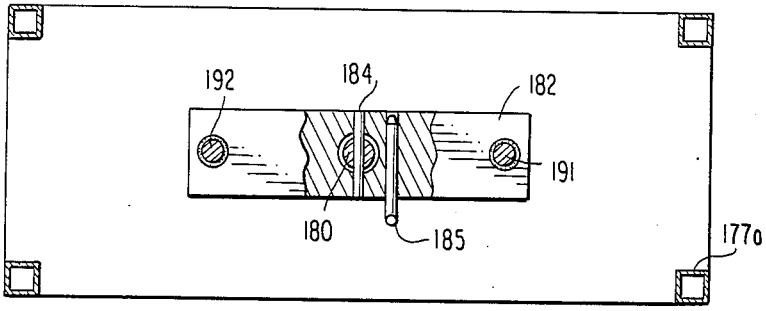
FIG. 2
FIG. 3
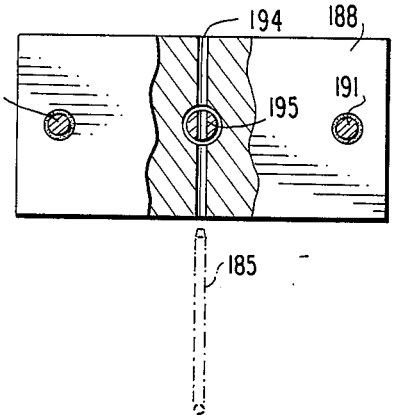
FIG. 1
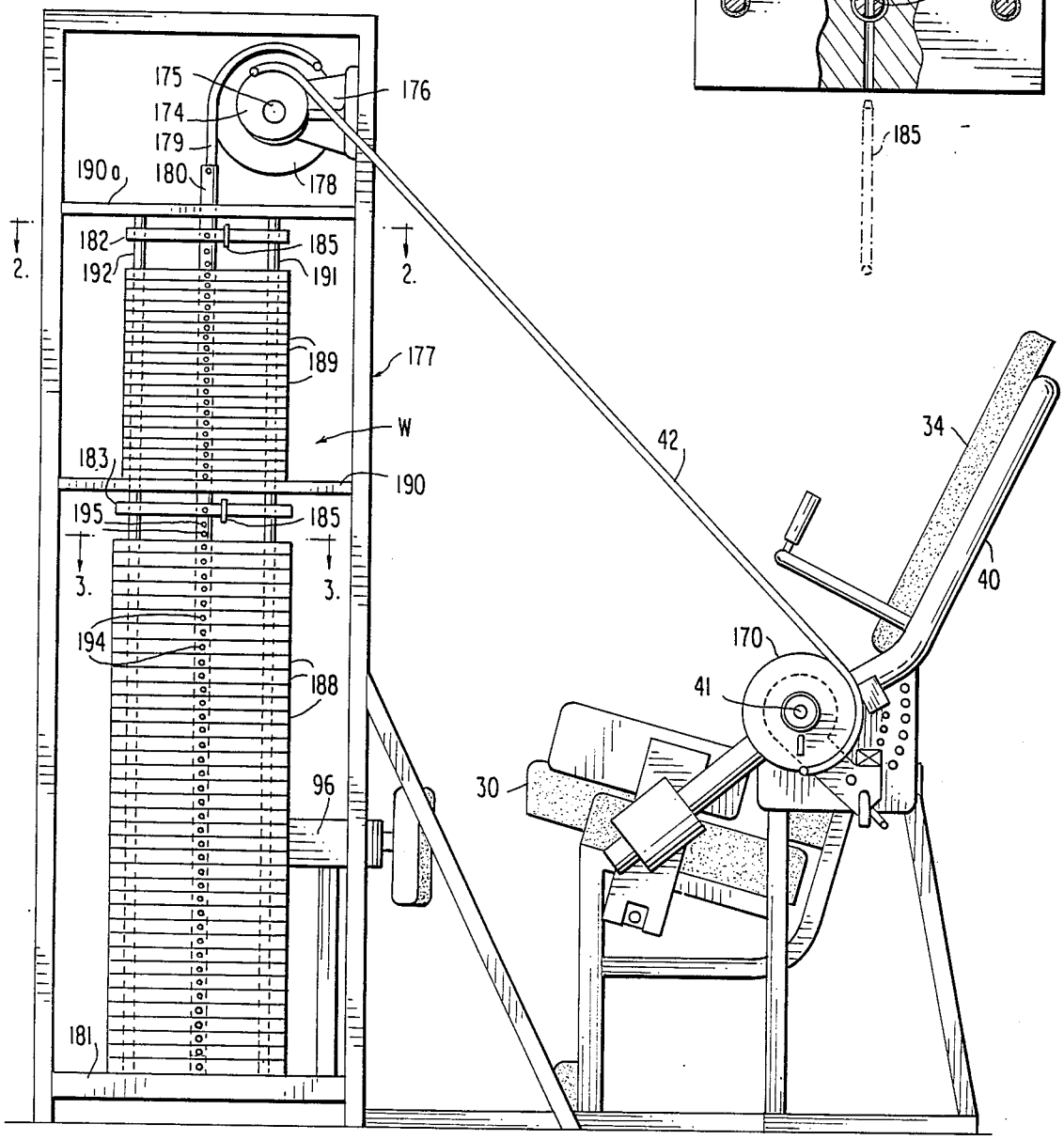

FIG. 4
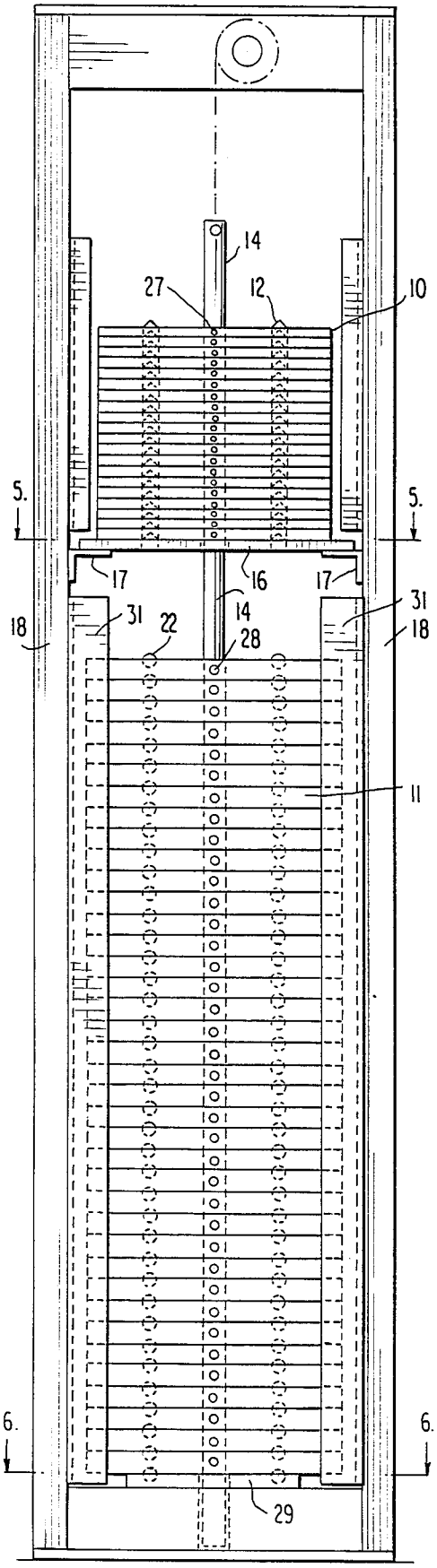
FIG. 5
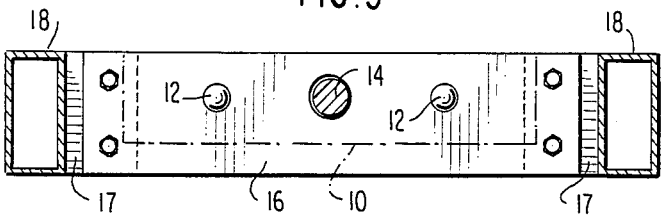
FIG. 6
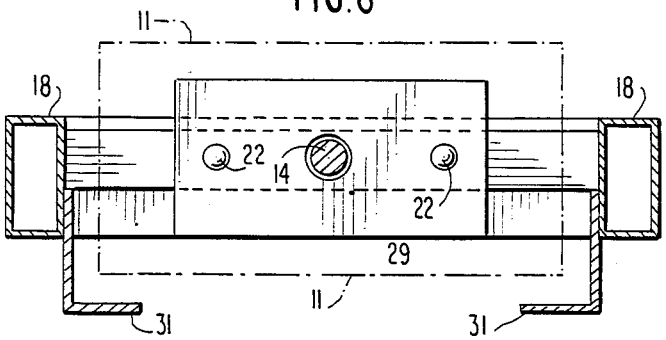
FIG. 7
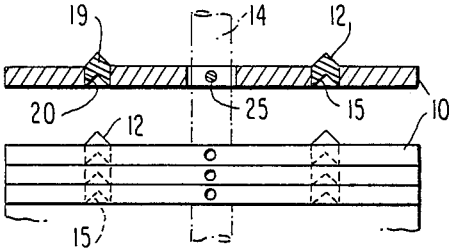
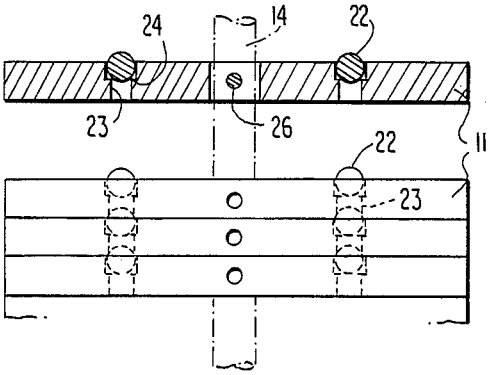
FIG. 8

COMPOUND WEIGHT SYSTEM

RELATED PATENT APPLICATION

The present application is a continuation in part of my prior copending patent application Ser. No. 07/060,679 filed June 11, 1987, pending and-entitled METHOD AND APPARATUS FOR TESTING OR EXERCISING MUSCLES OF THE LOWER TRUNK OF THE HUMAN BODY, the disclosure of which is hereby incorporated by reference into the present application as part hereof.

BACKGROUND AND OBJECTS OF THE INVENTION

The present invention generally relates to weight systems or weight stacks for use in muscle building, or exercising or testing the human body where the user usually pulls a cable which lifts one or more weights in the weight stack and then reduces pressure on the cable to allow the lifted weights to descend to a normal or lowered position from which the process may be repeated. The cable may be adapted to be handled directly by the user or, as is shown in the attached drawings, may be connected to a machine which upon movement caused by the user, causes the cable to move in one direction to lift the weights and upon movement of the machine in an opposite direction allows the cable to return to its original position allowing the weights to descend.

Because of space limitations, conventional weight stacks do not provide sufficient range of different weights to be selected for lifting, and the increments between the various weights to be lifted are too great or too little to provide a desired, precise selection of weight to be lifted by the user.

In addition, typical weight stacks of the prior art utilize fixed guide rods for maintaining the position of the weights in the stack in alignment relative to each other. When moving along the guide rods, the weights at times will engage the guide rods which will result in a frictional force in addition to the selected weight which must be overcome by the user, thus adversely effecting the accuracy of weight selection.

Accordingly, one of the objects of the present invention is to provide an improved weight system for exercising or testing muscles of the human body and which overcomes the above-noted problems. Included herein is the provision of such a weight system which may be adjusted in small or large increments with precision to suit the strength or choice of the user.

Another object of the present invention is to provide such a weight system in which frictional forces usually attending conventional weight stacks are reduced to increase the accuracy of weight selection.

A further object of the present invention is to provide a novel and improved weight system of the type described above which may be constructed for mass production and use in new or conventional machines for exercising or testing muscles of the human body.

SUMMARY OF INVENTION

In summary, the present invention provides at least two distinct groups of weights each of which may be connected to exercise equipment to the exclusion of the other group or together with the other group. In one preferred embodiment of the invention, the groups are vertically spaced from each other and each includes a plurality of stacked weights with the weights of one group differing in magnitude from the weights of the other group. Additionally, a connecting member extends through the weights for slidable movable relative to the weights but is connectable to the weights according to the selection of the user by means of first and second keys associated with the groups respectively. The weight that is keyed to the connecting member plus all weights stacked above the keyed weight are thus movable with the connecting member by the user during an exercise. When at rest, the groups of weights are supported by stationary supports respectively located at the bottom of the weight groups. Additionally, in the preferred embodiment, the weights each have a projection on one surface and a recess on the opposite surface for receiving the projection of the next adjacent weight to maintain the weights in a predetermined position relative to each other.

DRAWINGS

Other objects and advantages of the present invention will become apparent from the following detailed description taken in conjunction with the drawings in which:

FIG. 1 is a side elevational view of a compound weight system embodying the present invention and being connected for use with apparatus for exercising and/or testing the lumbar muscles;

FIG. 2 is an enlarged, cross-sectional view taken generally along lines 2—2 of FIG. 1;

FIG. 3 is an enlarged, cross-sectional view taken generally along lines 3—3 of FIG. 1;

FIG. 4 is a view generally similar to FIG. 1 but showing a second and preferred embodiment of the weight system of the present invention;

FIG. 5 is an enlarged, cross-sectional view taken generally along lines 5—5 of FIG. 4;

FIG. 6 is an enlarged, cross-sectional view taken generally along lines 6—6 of FIG. 4;

FIG. 7 is a fragmental elevational view of certain weights included in the upper weight stack of the embodiment of FIG. 4 and with one of the plates shown in cross section being connected to a rod for movement with the rod; and FIG. 8 is a view generally similar to FIG. 7 but showing weights included in the lower weight stack.

DETAILED DESCRIPTION

Referring now to the drawings in detail, there is illustrated in FIG. 1 a compound weight system constituting a first embodiment of the invention utilized with apparatus for exercising or testing the lumbar muscles. The apparatus includes a fixed seat generally designated 30 for receiving the user and a movement arm generally designated 40 mounted for pivotal movement about horizontal shafts 41 (one shown) as a result of the user exerting pressure against a pad 34 fixed to the movement arm 40. With the specific exercise apparatus shown, the user is anchored on the seat 30 with the pelvis immobilized so that only the lumbar muscles are used to exert a force against the movement arm to lift a preselected number of weights in the weight system w as will be described further below. A more detailed description of the apparatus may be gained by reference to my parent application identified above and which is incorporated by reference into the present application. Since the exercise apparatus per se forms no part of the present invention claimed herein and is shown merely to illustrate one type of exercise apparatus that may be employed with the compound weight system of the present invention, a further description here of the exercise apparatus is not believed to be necessary. Moreover and as will become apparent from the description below, any type of exercise apparatus may be used in conjunction with the weight system w of the present invention.

In the specific apparatus shown in FIG. 1, sprocket 170 is connected to weight system W by means of a cable or chain 42 having one end trained about and fixed to the periphery of the sprocket and an opposite end fixed to a cam 174. The cam is fixed to a shaft 175 journalled in bearing blocks 176 which are fixed to a stationary support frame 177. Also fixed to shaft 175 is a sprocket 178 having a chain 179 trained about and fixed at one end to the sprocket 178 and at the opposite end connected to weight system W. Support frame 177 is a generally rectangular open tower structure formed of structural steel members including 177*a* which are of sufficient strength to support the resistance weights to be described.

The weight system W incorporates a unique compound system of weights which in the specific embodiment shown, includes an elongated vertically extending connecting member or weight rod 180 connected at its top to the chain 179 and extending to the base 181 of the support frame 177. Fixed at spaced intervals along the rod 180 are a pair of top plates 182 and 183 which have a rectangular shape and receive the weight rod 180 through apertures provided centrally through the plates as illustrated in FIG. 2 which shows top plate 182. Weight rod 18 is fixed to top plates 182 and 183 by pins 184 fixed in traverse apertures aligned in the top plates and weight rod as shown in FIG. 2. In addition, each top plate 182 and 183 has a passage extending transversely thereof for receiving for storage, a weight selector key in the form of a pin 185 which may be removed and used to select the desired weight as will be described. In the present embodiment, the combined weight of the top plates 182 and 183, the weight rod 180 and the selector pins 185 is twenty pounds (20 lb.).

Associated with the top plates 182 and 183, respectively, are an upper and lower stack of weights in the form of rectangular plates or bars. The lower stack is supported on the base 181 of the support frame and includes, in the specific embodiment, thirty-eight plates 188 each weighing precisely twenty pounds (20 lbs.). Plates 188 may be made from any suitable material such as steel. The upper weight stack in the specific embodiment includes twenty plates 189 each made from aluminum and weighing precisely one pound (1 lb.). The upper weight stack is supported on a horizontal deck 190 fixed to and between the vertical members 177*a* of the support frame 177. To position the weight plates of each stack in alignment and to guide them during movement as will be described, a pair of elongated, parallel guide rods 191 and 192 are provided to extend through aligned apertures 193 formed through the weight plates at opposite end portions thereof equidistant from the weight rod 180 as best shown in FIGS. 1 and 2. Guide rods 191 and 192 are fixed to base 181 and deck 190, however, the weight plates are freely movable along the rods; it being understood that the circular apertures 193 in the weight plates are sufficiently greater than the diameter of the rods 191 and 192 to allow such free movement. As shown in FIG. 3 with respect to the weight plates 188 of the lower stack, each of the weight plates has a transversely extending passage 194 extending through the weight rod 180; it being understood that the weight rod 180 has a series of apertures 195 spaced throughout and along its length for registry with apertures 194 of the weight plates.

To select a weight to be lifted by the exerciser, the pins 185 may be inserted in the appropriate weight plates 188 and 189 of the lower and upper stacks to thus, in effect, connect all the weight plates above and including the weight plates bearing the pins 185, to be lifted during an exercise. The maximum stroke of the lifted weight plates is determined by engagement of the top plates 182 and 183 in each stack with the associated stationary stops 190 and 190*a* and hence, equal to the distance between the top plates and the associated stops; this distance being only three inches (3″) in the specific embodiment and, of course, the same for both stacks. In other embodiments of the invention, the distance between the stops 190 and 190*a* and the top plates 183 and 182 may be greater or less than 3 inches (3″) and in some embodiments, the upper stops 190 may be removed such as in the embodiment of FIGS. 4 to 8 to be described below.

With this compound weight stack, it is possible to vary the weight to be lifted in one pound increments from a minimum weight of twenty pounds (20 lbs.) when the pins 185 are left in their storage apertures of the top plates 182 and 183 to a maximum weight of eight hundred pounds (800 lbs.) when the pins 185 are inserted in the lowermost weight plates of each stack. It will be apparent that instead of the weight combinations shown and described above, weight plates of different magnitudes and numbers may be used in the upper and lower stacks. Additionally, three or more independent weight stacks may be utilized in accordance with the invention.

Referring now to FIGS. 4 through 8, a preferred embodiment of the invention is illustrated wherein the guide rods 191 and 192 included in the embodiment of FIG. 1 are eliminated. Instead, the preferred embodiment employs projections on one side, shown as the top of the plates 10, 11 and recesses on the opposite side, shown as the bottom of the plates 10, 11.

In the specific embodiment shown each of the plates 10 of the upper stack each has on its upper surface conical projections 12 located on opposite sides of the connecting rod 14 equidistant from the connecting rod 14 along the longitudinal central axis of the plate, it being understood that the rod 14 passes through a central aperture formed in the plates as best shown in FIGS. 5 and 6. The bottom surfaces of each of the upper plates 10 have conical recesses 15 complimentary in shape to the conical projections 12 and positioned in alignment with the latter for receiving the conical projections 12 when the plates are stacked as shown in FIGS. 4 and 7. Note that the conical projections 12 are fully received in the conical recesses 15 to align the plates with their surfaces squarely engaged against each other as shown in FIG. 8.

The stationary support plate 16 which supports the upper stack of plates 10 is also provided with conical projections 12 for receiving the conical recesses of the lowermost plate 10 of the upper stack as illustrated in FIG. 4. Stationary support plate 16 is secured to angles 17 fixed to the vertical frame members 18 as best shown in FIG. 4.

The conical projections 12 and recesses 15 may be formed in any suitable manner such as, for example, on opposite ends of studs 19 fixed in apertures 20 of the plates 10 as shown in FIG. 7. Other types of projections and recesses may be utilized such as illustrated, for example, on the weight plates 11 of the lower stack. The projections in this instance are spherical balls 22 fixed in countersunk apertures 23 formed through the plates 11 and having shoulders 24 against which the balls 22 are fixed as shown in FIG. 8 in any suitable manner. The balls 22 and apertures 23 are dimensioned such that when the plates 11 are stacked as shown in FIGS. 4 and 8, the upper portions of the balls 22 will be received in the apertures 23 as shown in FIG. 8 to maintain the plates in stacked alignment along the connecting rod 14 with the plate surfaces squarely engaged on each other as shown.

The lower stack of plates 11 are supported on a fixed support 29 which also is provided with balls 22 for receipt in the apertures 23 of the lowermost plate 11 of the lower stack. If desired, a pair of guards 31 in the form of inverted L-shaped rails may be secured along the vertical frame members 18 to cover the exposed corners of the weights 11 of the lower stack on the outer side of the weight stack.

As with the embodiment of FIG. 1, first and second keys in the form of pins 25 and 26 shown in FIGS. 7 and 8 respectively are used to connect any of the weights to the connecting rod 14, the keys being slidably received through transverse apertures formed in the plates and apertures 28 formed along the connecting rod 14 as shown in FIG. 4. Each of the upper weights 10 are lighter than each of the lower weights 11 as in the embodiment of FIG. 1 thus allowing a precise selection of various different weights. The connecting rod 14 of course may be connected at its upper end to a cable or chain of any type of exercise or muscle building machine or equipment.

Although the embodiments disclosed employ two weight stacks, it will be apparent that three or more weight stacks may be employed following the teachings of the present invention. It will also be seen that the embodiment of FIG. 4 uniquely eliminates the need for the guide rods 191 and 192 of the FIG. 1 embodiment to eliminate friction between the plates and the guide rods and to obtain unencumbered, smooth movement of the plates 10 and 11 with the connecting rod.

What is claimed is:

1. A system of weights adapted to be moved against the force imposed by weights, the system comprising in combination:

a first weight, a second weight spaced from and located below the first weight, a movable connecting member for moving one or both weights upon movement of the connecting member, first means for connecting the first weight to said connecting member independently of said second weight, second means for connecting the second weight to said connecting member independently of said first weight, and whereby movement of said connecting member serves to move any of the weights connected to said connecting member.

2. The weight system defined in claim 1 further including a first stationary support for supporting said first weight and a second stationary support for supporting said second weight independently of said first weight.

3. The weight system defined in claim 2 wherein said first and second means respectively include first and second keys engageable with said weights and said connecting member.

4. The weight system defined in claim 3 wherein said connecting member extends through said weights.

5. The weight system defined in claim 2 wherein said weights extend in generally spaced horizontal planes located one above the other and said connecting member extends vertically.

6. The weight system defined in claim 1 wherein said first and second means respectively include first and second keys engageable with said weights and said connecting member.

7. The weight system defined in claim 1 wherein said connecting member extends through said weights.

8. The weight system defined in claim 1 wherein said weights extend in generally spaced horizontal planes located one above the other and said connecting member extends vertically through the weights.

9. A system of weights adapted to be moved against the force imposed by weights the system comprising in combination;

a first weight, a second weight spaced from and extending below said first weight and being heavier than said first weight, a movable connecting member for moving either one or both weights upon movement of the connecting member, and means for selectively connecting said weights to said connecting member for movement therewith such that each of the weights may be connected to said connecting member while the other weight is excluded from movement with the connecting member and such that both weights may be connected to the connecting member for movement together with the connecting member.

10. The weight system defined in claim 9 wherein said connecting member extends through said weights.

11. The weight system defined in claim 9 wherein said weights are spaced one above the other and said connecting member is movable in a generally vertical direction.

12. The weight system defined in claim 11 further including first and second stationary supports for respectively supporting said weights.

13. The weight system defined in claim 9 wherein said connecting member extends vertically through said weights.

14. A system of weights adapted to be moved against the force imposed by the weights, the system comprising in combination, a first group of vertically stacked weights, a second group of vertically stacked weights located below said first group in spaced relationship and including weights heavier in magnitude than weights included in said first group, a connecting member movable in a generally vertical direction for moving a number of weights preselected from said first and second group, first means for operatively connecting a preselected number of weights from said first group to said connecting member independently of said second group for movement therewith, and second means for operatively connecting a preselected member of weights from said second group to said connecting member independently of said first group for movement with said connecting member.

15. The weight system defined in claim 14 wherein said connecting member extends vertically through the weights of said first and second group.

16. The weight system defined in claim 15 wherein said weights of said first and second group include weights having on one surface thereof a projection and on an opposite surface thereof a recess for receiving a projection located on a next adjacent weight for maintaining the weights in alignment relative to each other.

17. The weight system defined in claim 14 wherein said weights of said first and second group include weights having on one surface thereof a projection and on an opposite surface thereof a recess for receiving a projection located on a next adjacent weight for maintaining the weights in alignment relative to each other.

18. Apparatus for exercising the human body, the apparatus comprising in combination a movement arm movable by an exerciser, a compound weight system including first and second independent groups of weights with the magnitude of weights in one group being different than magnitude of weights in the other group, and means for selectively interconnecting a number of weights in one group with a number of weights in the other group and for connecting weights in both groups to the movement arm to act as a resistance to movement of said movement arm, and wherein said means is capable of connecting weights of either of said groups of weights to said movement arm independently of the weights of the other group, and wherein said means includes a connecting ember and means for connecting the weights of both groups of weights to said connecting member, and wherein said connecting member extends through the weights of both groups, and wherein said group of weights are located one above the other on independent supports respectively.

19. Apparatus defined in claim 18 wherein said weights in each group are in abutting interrelationship and have complementary projections and recesses receiving the projections for aligning said weights.

20. Apparatus for exercising the human body, the apparatus comprising in combination a movement arm engageable by the body to move the movement arm, a compound weight system including first and second independent groups of weights with the magnitude of weights in one group being different than the magnitude of weights in the other group, and means for selectively interconnecting a number of weights in one group with a number of weights in the other group and for connecting weights of both groups to the movement arm to act as a resistance to movement of said movement arm by said body, and wherein said groups of weights are located one above the other on fixed supports respectively with the weights of each group being stacked one on the other, and said compound weight system further includes a vertical connecting member connected to the movement arm and extending through the weights in both groups and being movable relative thereto, and wherein said means is capable of connecting weights of each of said groups of weights to the connecting member independently of the weights of the other group.

21. A compound weight system for exercising the body, the system comprising in combination:

a first plurality of individual weights associated with each other in abuttable relationship to form a first group of weights, a second plurality of individual weights associated with each other in abuttable relationship to form a second group of weights, said second group of weights being spaced from said first group of weights along a first direction, a connecting member for moving said weights extending along said first direction and being movable along said first direction, and means for selectively connecting to the connecting member for movement therewith weights of both groups and further being capable of connecting to the connecting member weights of either group independently and to the exclusion of the weights of the other group.

22. The compound weight system defined in claim 21 wherein said connecting member extends through the weights of both groups.

23. The compound weight system defined in claim 21 wherein the said group of weights is spaced below said first group of weights, and said weights of each group are stacked one above the other.

24. The compound weight system defined in claim 21 wherein said weights and plates and all of said weights extend generally parallel too each other in horizontal planes.

25. A compound weight system defined in claim 21 wherein the weights of one group are heavier than the weights of the other group.

26. The compound weight system defined in claim 25 wherein the weights of the first group are each on the order of one pound and the weights of the other group are each on the order of twenty pounds.

27. The compound weight system defined in claim 21 wherein each of said second plurality of weights has on a surface thereof a projection and on an opposite surface thereof a recess for receiving a projection located on a next adjacent weight for maintaining said second plurality of weights in a certain position relative to each other.

28. The compound weight system defined in claim 27 wherein said projection and recess have generally semispherical complementary shapes.

29. The compound weight system defined in claim 27 wherein said projection and recess have generally conical complementary shapes.

30. The compound weight system defined in claim 28 wherein each of said second plurality of weights has a shoulder in said recess thereof and said projection is a spherical ball seated on said shoulder.

* * * * *